US008276440B2

(12) United States Patent
Wach et al.

(10) Patent No.: US 8,276,440 B2
(45) Date of Patent: Oct. 2, 2012

(54) DEVICE FOR ERROR MONITORING OF CHASSIS COMPONENTS OF RAIL VEHICLES

(75) Inventors: Jörg Johannes Wach, München (DE); Johannes Schuhmacher, München (DE); Marc Oliver Herden, München (DE); Reinhold Mayer, Karlsfeld (DE); Ulf Friesen, Neubiberg (DE)

(73) Assignee: Knorr-Bremse Systeme fur Schienenfahrzeuge GmbH, Munich (DE)

( * ) Notice: Subject to any disclaimer, the term of this patent is extended or adjusted under 35 U.S.C. 154(b) by 422 days.

(21) Appl. No.: 12/598,788

(22) PCT Filed: May 16, 2008

(86) PCT No.: PCT/EP2008/003953

§ 371 (c)(1),
(2), (4) Date: Nov. 4, 2009

(87) PCT Pub. No.: WO2008/141774

PCT Pub. Date: Nov. 27, 2008

(65) Prior Publication Data

US 2010/0116041 A1 May 13, 2010

(30) Foreign Application Priority Data

May 22, 2007 (DE) ..... 10 2007 024 066

(51) Int. Cl.
*G01M 17/10* (2006.01)

(52) U.S. Cl. ..... 73/117.01; 73/11.06

(58) Field of Classification Search ..... 73/11.04, 73/11.05, 11.06, 11.07, 11.08, 11.09, 117.01, 73/117.03

See application file for complete search history.

(56) References Cited

U.S. PATENT DOCUMENTS

| | | | | |
|---|---|---|---|---|
| 4,843,885 | A * | 7/1989 | Bambara | 73/660 |
| 5,150,618 | A * | 9/1992 | Bambara | 73/660 |
| 6,008,731 | A | 12/1999 | Capan | |
| 6,161,962 | A | 12/2000 | French et al. | |
| 6,672,681 | B1 | 1/2004 | Moretti et al. | |
| 7,698,962 | B2 * | 4/2010 | LeFebvre et al. | 73/862.621 |
| 2008/0156944 | A1 | 7/2008 | Aurich et al. | |
| 2010/0288157 | A1 * | 11/2010 | LeFebvre et al. | 105/218.1 |

FOREIGN PATENT DOCUMENTS

DE 199 11 848 A1 9/2000

(Continued)

OTHER PUBLICATIONS

English Translation of the International Preliminary Report on Patentability dated Dec. 3, 2009 for International Application No. PCT/EP2008/003953.

(Continued)

*Primary Examiner* — Eric S McCall
(74) *Attorney, Agent, or Firm* — Barnes & Thornburg LLP.

(57) ABSTRACT

The invention relates to a device for the error monitoring of chassis components of rail vehicles, including at least one vibration sensor. According to one embodiment of the invention, at least one vibration sensor is arranged on a bogie frame or on a wheel set bearing of an axis of a bogie of the rail vehicle such that the detection direction thereof has a component in the moving direction (x-direction) or a component perpendicular to the moving direction (y-direction) and at the same time a component parallel to the vertical axis (z-direction) of the rail vehicle.

6 Claims, 4 Drawing Sheets

FOREIGN PATENT DOCUMENTS

| | | | |
|---|---|---|---|
| DE | 199 53 677 | C1 | 6/2001 |
| DE | 101 45 433 | A1 | 4/2002 |
| DE | 600 02 450 | T2 | 4/2004 |
| DE | 10 2005 010 118 | A | 9/2008 |
| EP | 1 317 369 | B1 | 4/2005 |
| WO | WO 00/51869 | | 9/2000 |
| WO | WO 02/47954 | A1 | 6/2002 |
| WO | WO 2005/105536 | A1 | 11/2005 |

OTHER PUBLICATIONS

English Translation of a Chinese Office Action, Chinese Patent Application No. 200880015476.5.

International Search Report for International Application No. PCT/EP2008/003953, dated Aug. 28, 2008.

* cited by examiner

DEVICE FOR ERROR MONITORING OF CHASSIS COMPONENTS OF RAIL VEHICLES

CROSS-REFERENCE TO RELATED APPLICATIONS

The present application claims the benefit of priority to International Patent Application No. PCT/EP2008/003953 filed 15 May 2008, which further claims the benefit of priority to German Patent Application No. 10 2007 024 066.1 filed 22 May 2007, the contents of which are incorporated herein by reference in their entirety.

BACKGROUND

The invention is based on a device for monitoring undercarriage components of rail vehicles for faults, comprising at least one vibration pickup.

The monitoring systems for undercarriages are becoming increasingly important in rail vehicle transportation. On the one hand, for safety reasons, these monitoring systems are required normatively and in guidelines. Examples of this are the following systems which are required throughout Europe by the TSI (Technical Specification for Interoperability—Official Journal of the European Community) for high speed trains:

On-board systems for detecting derailing,

On-board systems for hot-box detection and/or for detecting damage to bearings, and On-board systems for detecting instability and/or defective shock absorbers.

On the other hand, the use of undercarriage monitoring systems leads to the diagnosis and early detection of damaged components, critical states and other faults in order to achieve early and status-oriented maintenance. Objectives here are shorter downtimes, better utilization of components and therefore reduction of costs.

For example, in the ICE, a system for detecting unstable running is used, and in relatively new automatic underground railway systems a system for detecting derailing is used. These systems have in common the fact that they are constructed to function and act independently. Each of these systems uses dedicated sensors.

For instability detection, one or more sensors are usually mounted on the bogie frame, which sensors measure the lateral acceleration (in the transverse direction with respect to the direction of travel x) in a specific frequency range and generate an alarm message when a limiting value is exceeded.

DE 101 45 433 C2 and EP 1 317 369 describe a method and a device for monitoring faults in components of a rail vehicle, which method and device are also based on the measurement of acceleration values and are mounted on lateral damper brackets attached to the wagon body. The detection direction of the acceleration pickup is parallel to the direction of travel there.

An example of a method and a device for detecting derailing is described in DE 199 53 677. Here, measurement signals of an acceleration sensor which is arranged on an axle bearing are evaluated directly. The measured acceleration values are integrated twice and compared with a limiting value. The simple acceleration sensor has a detection direction in the direction of the vertical axis (z direction) of the rail vehicle. However, according to the document, acceleration sensors which simultaneously have detection directions in the direction of travel (x direction), in the transverse direction with respect to the direction of travel (y direction) and in the direction of the vertical axis (z direction). Such an acceleration pickup is what is referred to as a multiple pickup, i.e., it is actually composed of at least two, here three acceleration pickups, each of which measures in one detection direction. Such multiple pickups and their associated evaluation directions are, however, relatively expensive.

A further possible way of detecting derailing is provided by a pneumatic monitoring device which operates in a purely pneumatic way. A basis for such a monitoring device is UIC541-08 "Derailing detectors for goods wagons". The device is located on the wagon body of the goods wagon and controls the vertical accelerations here. In this context, a spring/mass oscillator, which opens a pneumatic valve at a specific limiting value, is used as the sensor element.

The problem with these systems, in particular within the scope of the functions of the detection of instability and detection of derailing, is the high degree of expenditure on sensor systems because a large number of individual sensors are used at different installation locations.

SUMMARY

In contrast to the above, the invention provides a device for monitoring undercarriage components of rail vehicles for faults in such a way that the device requires the smallest possible number of simple and cost-effective sensors and nevertheless provides extensive monitoring of the undercarriage components. In addition to the savings in terms of costs as a result of a smaller number of sensors and therefore less expenditure on cabling, the intention is also to reduce the complexity of the technical equipment.

The invention is based on the idea of using a common sensor system for different functions of the monitoring of undercarriage components of rail vehicles for faults, such as the functions of the detection of instability and the detection of derailing which are mentioned at the beginning. The sensors are embodied as vibration pickups which, as a function of their arrangement according to the invention can detect in the direction of the vertical axis of the rail vehicle (z direction) and in the transverse direction with respect to the direction of travel (y direction) or in the direction of travel (x direction). The invention provides two variants here:

a) Arrangement of at least one vibration pickup on a bogie frame or on a wheel set bearing of an axle of a bogie of the rail vehicle in such a way that its detection direction has a component in the direction of travel (x direction) or a component perpendicular to the direction of travel (y direction) and at the same time a component parallel to the vertical axis (z direction) of the rail vehicle, b) Provision of vibration pickups which are assigned to wheel set bearings of one axle, one vibration pickup of which is arranged on the one wheel set bearing of the axle in such a way that its detection direction is parallel to the direction of travel, and another vibration pickup of which is arranged on the other wheel set bearing of the axle in such a way that its detection direction is parallel to the vertical axis of the rail vehicle.

In the variant a), a vectorial addition of the acceleration values in the z direction to those of the transverse acceleration or longitudinal acceleration (y and x directions) occurs owing to the oblique orientation of the detection direction of the vibration pickup. The measured acceleration values are the sum of the vectorial individual accelerations in the z direction and y direction or in the z direction. These values already form a measure of the tendency of the undercarriage to have an unstable driving state or to be derailed. More selective monitoring can additionally be carried out by frequency-specific assessment of the measured acceleration values. The vibrations on the different spatial axes occur in different frequency bands. Therefore, in the case of unstable behavior there are tendentially lower frequencies in the transverse direction and longitudinal direction than in the vertical axis. In the case of derailing, a monitoring criterion is formed by the relatively high frequency components in the vertical axis. The selective evaluation of different frequency bands therefore permits selective monitoring for an unstable driving state and for derailing.

A component is continuously present in the specified directions (x, y and z directions) if the angle of the detection direction in the corresponding plane is within a range of 0 degrees to 90 degrees without, however, its limits including 0 degrees and 90 degrees. The angle of the detection direction may be particularly in the range from 10 to 80 degrees.

It is, therefore, possible in each case to sense, with just a single vibration pickup, two detection directions which are perpendicular to one another (z direction and y direction or z direction and x direction). As a result, with just one vibration pickup on the bogie or on an axle, definitive information about possible instability can be obtained by monitoring the transverse acceleration or longitudinal acceleration, and at the same time definitive information about a possible inclination to derail can be obtained by monitoring the acceleration in the direction of the vertical axis.

With just a single vibration pickup per bogie evening of the actuation sensor is minimal.

According to variant b) each wheel set bearing of an axle of a bogie is assigned a vibration pickup. In this context, the detection directions of the two vibration pickups which are assigned on each side of an axle are respectively perpendicular to one another, specifically in the direction of travel (x direction) and in the direction of the vertical axis (z direction). As a result, by evaluating the acceleration signals of the vibration pickups, the functions of detection of derailing and detection of instability can also be carried out. Because the vibration pickups are assigned to the wheel set bearings, axle bearing monitoring can also take place at the same time because excessive vibrations in the region of the wheel set bearings indicate defects in this region.

On the other axle of the bogie, the same arrangement may be implemented with inverted sides with respect to the detection directions. This results in each case in the same detection direction, considered diagonally over the axles of the bogie. As a result, in each case two vibration pickups with in each case the same detection direction and therefore redundancies for the respective detection direction are present per bogie.

Compared to a solution in which a wheel set bearing is assigned a double signal generator in the form of a combined vibration pickup for two detection directions, such as described for example in DE 199 53 677 C1, more extensive monitoring quality of the undercarriage components is obtained because each wheel set bearing is monitored. On the other hand, the expenditure involved in this is not high because each wheel set bearing is assigned just a single vibration pickup.

In addition to the specified monitoring functions of detection of instability and detection of derailing, the device according to the invention can also be used to implement further monitoring and diagnostic functions by suitable evaluation methods and corresponding evaluation electronics. When the sensor system is arranged on the bogie frame, it is therefore possible to monitor the components which are installed directly on the frame, such as the connecting rods, guide bushings and the frame itself.

In particular when the vibration pickups are installed directly on the wheel set bearing or on the wheel set bearing housing, additional monitoring functions and diagnostic functions are conceivable such as, for example, the detection of flat points, the detection of bearing damage or even the detection of damage in the wheel set shaft and in or on the wheel itself.

As a result of the measures specified in the subclaims, advantageous developments and improvements of the invention disclosed in the independent claims are possible.

According to variant a), the detection direction of the vibration pickup may be particularly located in a plane perpendicular to an axle of the bogie, and has an angle of 45 degrees in relation to the vertical axis (z direction) and in relation to an axis (x direction) which is arranged parallel to the direction of travel. Because the components are then of equal size, balanced signals may be obtained for the longitudinal vibrations and vertical vibrations of the bogie or of the wheel set bearings.

Alternatively, the detection direction of the vibration pickup can be located in a plane perpendicular to the direction of travel and can have an angle of 45 degrees in relation to the vertical axis (z direction) and in relation to an axis (y direction) which is arranged perpendicular to the direction of travel. In this case, balanced signals are obtained for the transverse vibrations and vertical vibrations of the bogie or of the wheel set bearings.

According to one development of variant a), in each case a vibration pickup may be particularly arranged on just one wheel set bearing of the two wheel set bearings of an axle. If the detection direction of this vibration pickup is located in a plane perpendicular to the axle and may assume an angle of 45 degrees in relation to the vertical axis and in relation to an axis which is arranged parallel to the direction of travel, it is also possible to obtain balanced definitive information about the tendency to derail and the stability behavior of the undercarriage based on the measurement signal of the vibration pickup. If, for example, two such vibration pickups are arranged diagonally with respect to a vertical rotational axis of the bogie, a redundant measurement is additionally obtained. This increases the safety of the monitoring device.

In this variant, the vibration pickup may be combined with a pulse generator. The use of integrated sensors which supply the signals for the electronic monitoring unit and additionally sense the axle rotational speeds, for example for anti-skidding protection, further reduces the expenditure on the sensor installation and on cabling.

In order to minimize the expenditure on manufacturing costs and mounting costs and on cabling, according to one development of variant b) just a single vibration pickup is provided for each wheel set bearing of an axle. These vibration pickups may be arranged on the wheel set bearings of the axles of the bogie in such a way that, viewed in the direction of travel, the detection directions of the vibration pickups alternate on each side of the vehicle. Consequently, vibration pickups with the same detection direction are arranged diagonally with respect to the vertical rotational axis of the bogie. This results in advantageous redundancy, which increases the fail safety of the monitoring device.

In this variant, at least one vibration pickup may also be combined with a pulse generator, which provides the advantages already mentioned above. In addition, a temperature sensor for measuring the instantaneous bearing temperature in a wheel set bearing can also be integrated into the combination sensor. Reference is made to DE 10 2005 010 118 with respect to a possible design of such a combination sensor.

Last but not least, at least one electronic evaluation unit of the device for monitoring undercarriage components for faults can be an integral component of an anti-skid and/or brake control system of the rail vehicle, as is likewise described in DE 10 2005 010 118.

More precise details will be found in the following description of exemplary embodiments.

BRIEF DESCRIPTION OF THE FIGURES

Exemplary embodiments of the invention are presented below in the drawing and explained in more detail in the following description. In the figures.

DESCRIPTION OF THE EXEMPLARY EMBODIMENTS

Figure 1:
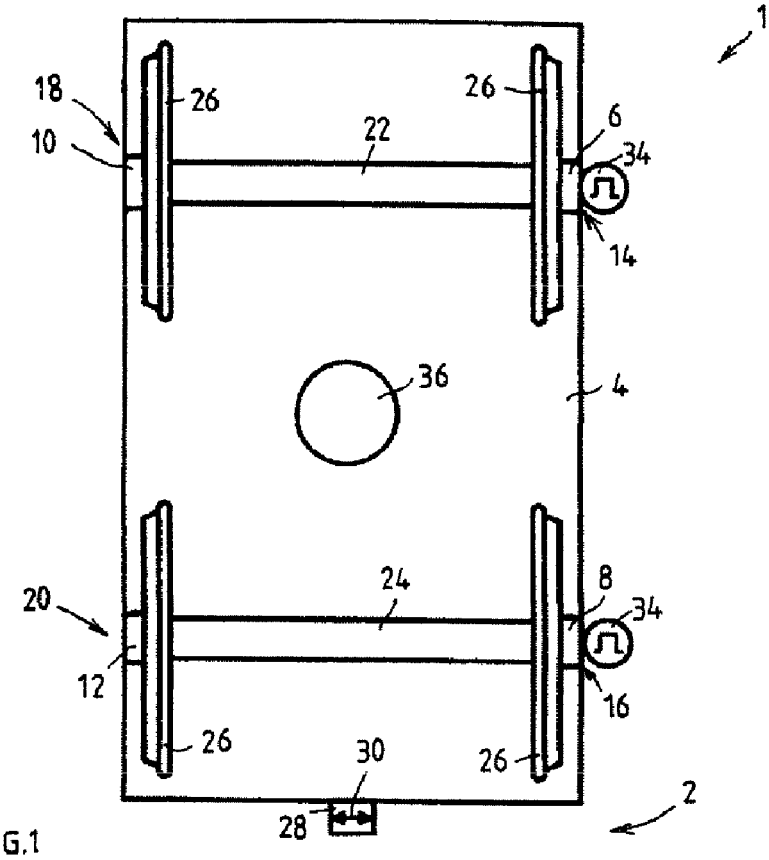
FIG. 1 shows a schematic plan view of a bogie with part of a device for monitoring undercarriage components of rail vehicles for faults, according to a first embodiment of the invention.

FIG. 1 illustrates a schematic plan view of a bogie 1 with part of a device 2 for monitoring undercarriage components of rail vehicles for faults, according to a first embodiment of the invention.

The bogie 1 is arranged such that it can rotate about a vertical rotational axis 36 with respect to a wagon body (not illustrated), and said bogie 1 contains a bogie frame 4 which is supported on a wagon body of the rail vehicle by a secondary suspension system, which is likewise not shown because it is unimportant for the invention.

The bogie frame 4 is supported, on the other hand, by a primary suspension system on four wheel set bearing housings 6, 8, 10, 12, in each of which a wheel set bearing 14, 16, 18 and 20 for supporting an axle 22, 24 is accommodated, which axle 22, 24 has two wheels 26 at the ends. Overall, two axles 22, 24 are present per bogie 4.

Figure 2:
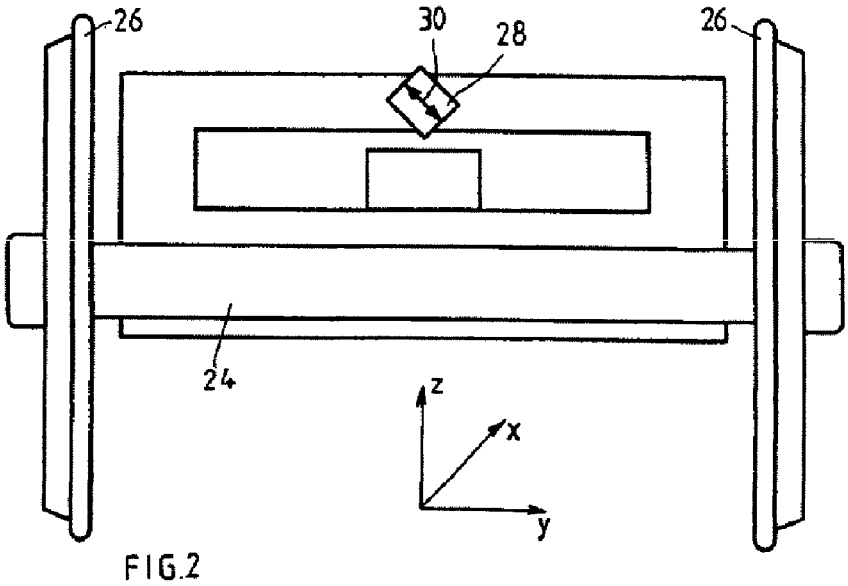
FIG. 2 shows a schematic end view of the bogie from FIG. 1.

In order to monitor the bogie 1 and its components 4 to 20, the device 2 for monitoring faults is provided, only one vibration pickup 28 of which can be seen in FIGS. 1 and 2.

The vibration pickup 28 is arranged on the bogie frame 4 of the bogie in such a way that its detection direction (symbolized by an arrow 30) has a component parallel to the vertical axis (z direction) and a component in the direction of travel (x direction) or a component perpendicular to the direction of travel (y direction) of the rail vehicle. The detection direction 30 of the vibration pickup 28, which is embodied, for example, as an acceleration sensor, may have a component perpendicular to the direction of travel (y direction) and at the same time a component parallel to the vertical axis (z direction) of the rail vehicle, as is apparent in particular from FIG. 2.

Then, owing to the oblique orientation of the detection direction 30 of the vibration pickup 28, a vectorial addition of the acceleration values in the z direction to those in the y direction (transverse acceleration) occurs. The instantaneous acceleration values in the z direction and in the y direction are calculated by evaluation electronics 32 (shown in FIG. 7) based on the measurement signals of the vibration pickup 28 and they form a measure of the tendency of the bogie to derail (measurement signal in the z direction) and/or to assume unstable travel states such as excessive shunting (measurement signal in the y direction).

Furthermore, each axle 22, 24 is assigned a known pulse generator 34 for measuring the rotational speed, which pulse generator 34 may be arranged in the assigned wheel set bearing housing 6, 8 or is connected by flanges thereto by its own housing.

According to the embodiment in FIG. 1 and FIG. 2, the detection direction 30 of the vibration pickup 28 may be particularly located in a plane perpendicular to the direction of travel (x direction) and has an angle of, for example, 45 degrees in relation to the vertical axis (z direction) and in relation to an axis (y direction) which is arranged parallel to the direction of travel. Because the components in the direction of these axles are then of equal size, balanced signals may be produced for the transverse vibrations and vertical vibrations of the bogie 1.

Alternatively, the detection direction 30 of the vibration pickup 28 can be located in a plane perpendicular to an axle 22, 24 of the bogie and can have an angle of, for example, 45 degrees in relation to the vertical axis (z direction) and in relation to the direction of travel (x direction). In this case, balanced signals are obtained for the longitudinal and vertical vibrations of the bogie 1.

Figure 3:
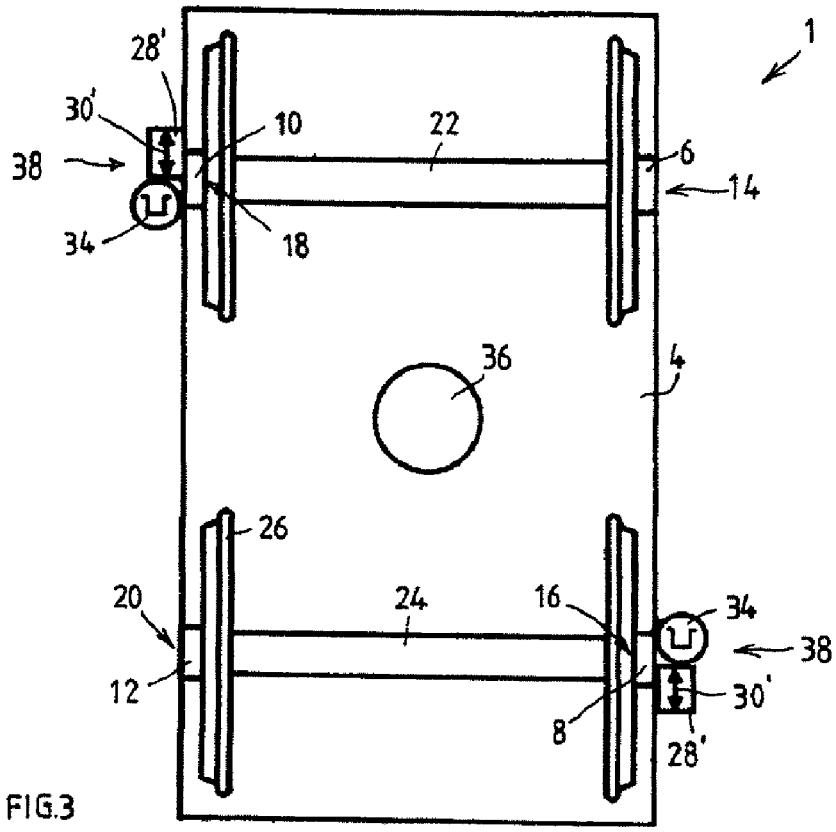
FIG. 3 shows a schematic plan view of a bogie with part of a device for monitoring undercarriage components of rail vehicles for faults, according to a further embodiment of the invention.
Figure 4:
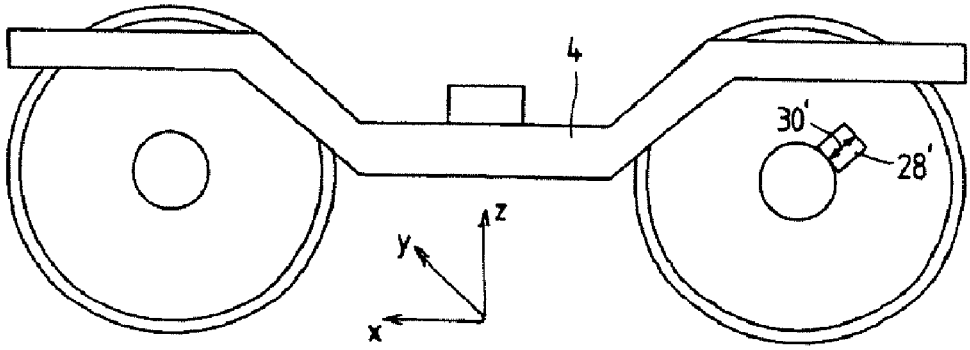
FIG. 4 shows a schematic side view of the bogie from FIG. 3.

According to the embodiment in FIG. 3 and FIG. 4, a vibration pickup 28' is arranged on, in each case, just one wheel set bearing 16, 18 of the two wheel set bearings 16 and 20 or 14 and 18 of an axle 22, 24. If the detection directions 30' of the two vibration pickups 28' are directed in the same way and are located in a plane perpendicular to the axles 22, 24 of the bogie 1 and, for example, have an angle of 45 degrees in relation to the vertical axis (z direction) and in relation to an axis (x direction) which is arranged parallel to the direction of travel, it is possible to obtain definitive balanced information about the tendency to derail and about the stability behavior of the undercarriage based on the measurement signals of the vibration pickups 28'. The two vibration pickups 28' which are assigned to the axles 22, 24 may be particularly arranged, as shown in FIG. 3, diagonally with respect to the vertical rotational axis 36 of the bogie 1. In this embodiment, the vibration pickups 28' are additionally combined with, in each case, one pulse generator 34 for measuring the wheel speed in order to form an integrated combination sensor 38.

Figure 5:
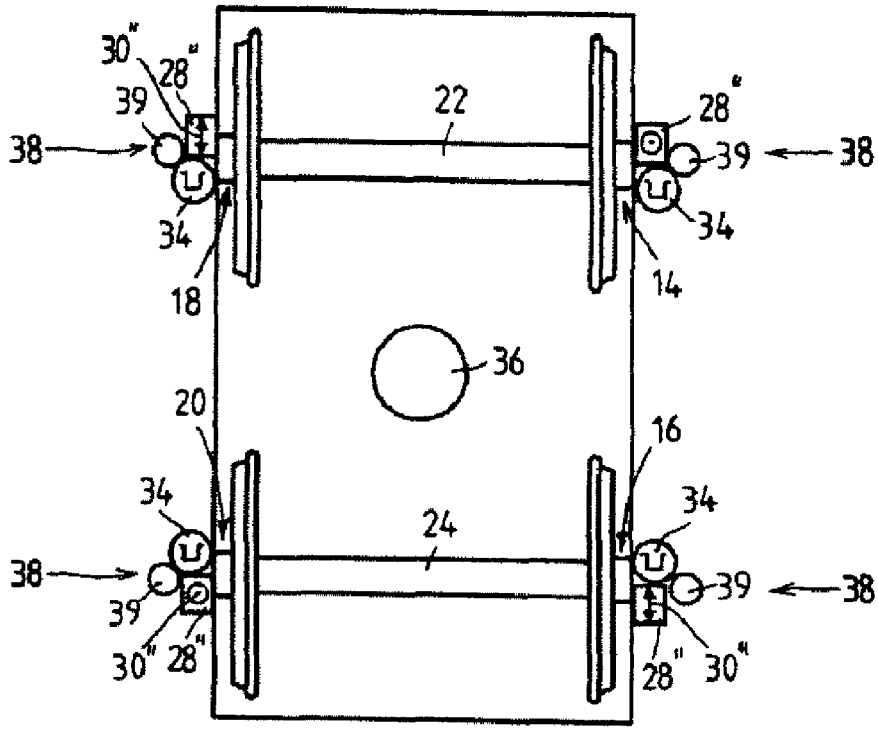
FIG. 5 shows a schematic plan view of a bogie with part of a device for monitoring undercarriage components of rail vehicles for faults, according to a further embodiment of the invention.
Figure 6:
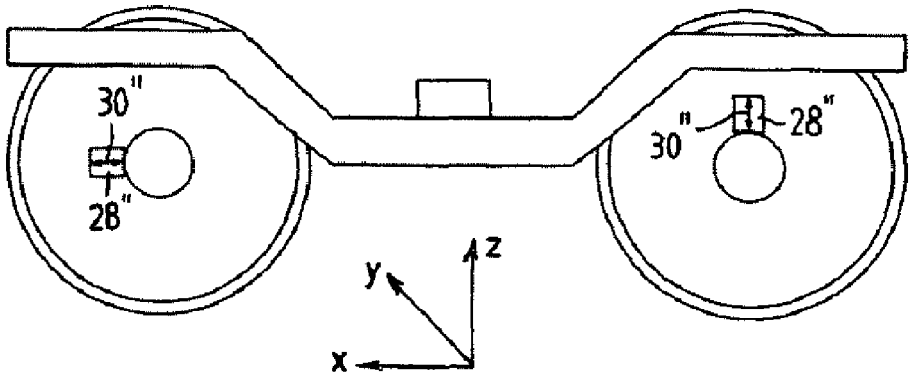
FIG. 6 shows a schematic side view of the bogie from FIG. 5.

In the embodiment in FIG. 5 and FIG. 6, each wheel set bearing 14 to 20 of the bogie 1 may be assigned a vibration pickup 28", with the vibration pickup 28" being arranged on the one wheel set bearing 16 or 18 of the respective axle 24, 22 in such a way that its detection direction 30" is parallel to the direction of travel (x direction), and with the other vibration pickup 28" of which being arranged on the other wheel set bearing 14 or 20 of the respective axle 22, 24 in such a way that its detection direction 30" is parallel to the vertical axis (z direction) of the rail vehicle. Accordingly, the detection directions 30" of the two vibration pickups 28" which are assigned to the respective axle 22, 24 of the bogie 1 are each perpendicular to one another and point in the direction of travel (x direction) and in the direction of the vertical axis (z direction). Therefore, vibration pickups 28" with the same detection direction 30" may be arranged diagonally in relation to the rotational axis 36 of the bogie 1.

In this variant also, at least one vibration pickup 28" may be combined with a pulse generator 34 in a combination sensor 38, which provides the advantages already mentioned above. In addition, a temperature sensor 39 for measuring the instantaneous bearing temperature in the respective wheel set bearing 14 to 20 can also be integrated in the combination sensor 38.

In all the embodiments, only simple vibration pickups 28, 28', 28", i.e. which act in just one detection direction 30, 30' and 30", of the same type may be used.

Figure 7:
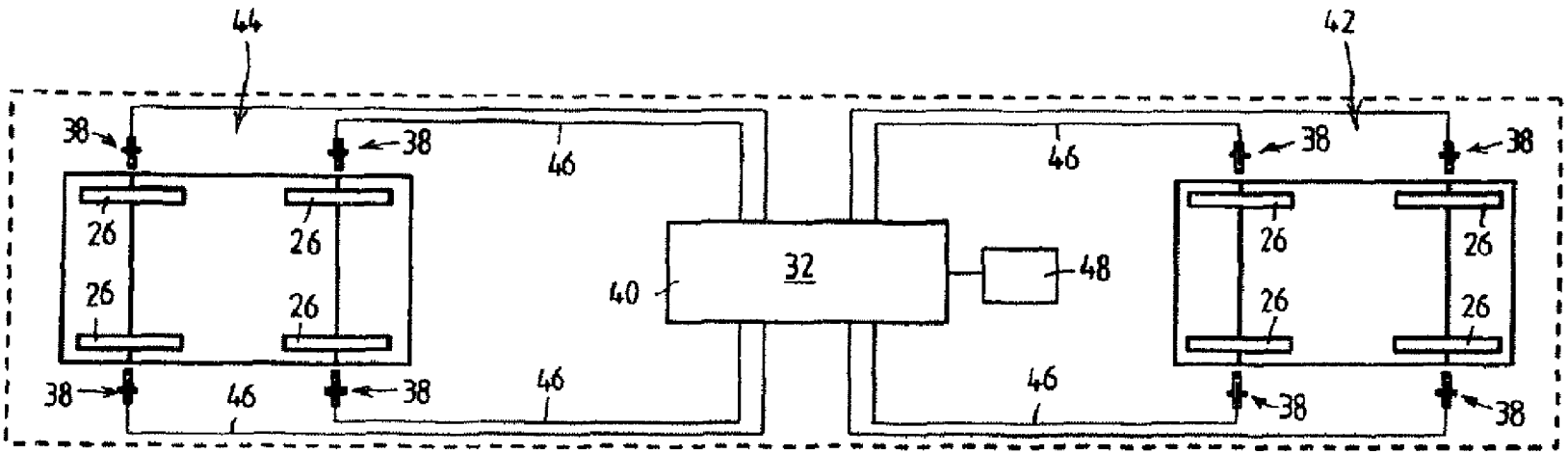
FIG. 7 shows a schematic circuit diagram of a device for monitoring undercarriage components of rail vehicles for faults, according to the embodiment from FIG. 5 and FIG. 6.

FIG. 7 shows the evaluation electronics 32 of the device 2 in anti-skid electronics 40 of an anti-skid system for setting optimum slip between the wheels of a passenger car with two bogies 42, 44 and the rails for a velocity up to 200 km/h, which evaluation electronics 32 are connected with a signal-transmitting connection to the respective combination sensors 38 on the wheel set bearings via sensor lines 46. The passenger car may be equipped, per wheel set bearing, with a combination sensor 38 for measuring the wheel speed (pulse generator), the wheel bearing temperature (temperature sensor) and the wheel acceleration in the respective detection direction 30" (simple acceleration pickup). The measurement signals of these sensors 38 are read into the central evaluation electronics 32 and evaluated there. Overall, the following monitoring functions can be implemented using the combination sensors 38:

- Monitoring of rolling (detection of wheels which are not rotating)
- Warm and hot-box detection (monitoring of the temperature of the wheel set bearings),
- Detection of damage to bearings by measuring vibration,
- Detection of unstable running or of defective dampers in the undercarriage,
- Detection of derailing, and
- Detection of flat points and non-round wheels.

Furthermore, additional diagnostic functions for the early detection of defective components are possible. Last but not least, diagnosis of the rail line for damage to the track is also conceivable. Reading in or reading out or a display of data can then be carried out by an input/output device 48.

The invention claimed is:

1. A device for monitoring undercarriage components of rail vehicles for faults, containing at least one vibration pickup wherein at least one vibration pickup is arranged on a bogie frame or on a wheel set bearing of an axle of a bogie of the rail vehicle in such a way that a detection direction of the at least one vibration pickup has a component parallel to a vertical axis (z-axis direction) of the rail vehicle and at the same time a component perpendicular to the vertical axis, and wherein the detection direction of each vibration pickup of the at least one vibration pickup lies in a plane which is perpendicular to the direction of travel (x-axis direction) and has an angle in a range of 10 to 80 degrees in relation to the vertical axis (z direction) and in relation to an axis (y direction) which is arranged perpendicular to the direction of travel.

2. The device of claim 1, wherein a single vibration pickup is arranged on the bogie frame of the bogie.

3. The device of claim 1, wherein the at least one vibration pickup is arranged on just one wheel set bearing of the wheel set bearings of an axle of the bogie.

4. The device of claim 1, wherein at least one vibration pickup is embodied as an acceleration sensor and is integrated, together with at least one speed sensor for measuring the instantaneous wheel speed and/or with a temperature sensor for measuring the instantaneous bearing temperature of a wheel set bearing, in a combination sensor.

5. The device of claim 1, further comprising at least one electronic evaluation unit which is provided as an integral component of an anti-skid and/or brake control system of the rail vehicle.

6. The device claim 1, wherein at least two of the vibration pickups are redundant to one another.

* * * * *